United States Patent [19]

Erickson

[11] 4,283,005

[45] Aug. 11, 1981

[54] PUMP AND CENTRIFUGAL SEPARATOR APPARATUS

[75] Inventor: John W. Erickson, Huntington Beach, Calif.

[73] Assignee: Kobe, Inc., City of Commerce, Calif.

[21] Appl. No.: 80,379

[22] Filed: Oct. 1, 1979

[51] Int. Cl.[3] ..... B04B 1/10; B04B 11/00

[52] U.S. Cl. ..... 233/47 A; 233/20 A; 415/89

[58] Field of Search ..... 233/47 R, 47 A, 46, 233/2, 20 R, 20 A, 28, 38, 1 D, 1 R; 415/89; 417/84

[56] References Cited

U.S. PATENT DOCUMENTS

| | | | |
|---|---|---|---|
| 2,500,100 | 3/1950 | Strezynski | 233/47 A |
| 3,795,459 | 3/1974 | Erickson | 415/89 |
| 3,817,659 | 6/1974 | Erickson | 417/84 |
| 3,838,939 | 10/1974 | Erickson | 415/89 |
| 4,036,427 | 7/1977 | Erickson | 415/89 |
| 4,044,943 | 8/1977 | Brown | 233/46 |

*Primary Examiner*—Robert W. Jenkins
*Attorney, Agent, or Firm*—William C. Norvell, Jr.

[57] ABSTRACT

The invention relates to agitating means for preventing the accumulation of particulate matter at the contaminate outlet orifices in a pump and centrifugal separator apparatus. The pump-separator apparatus includes a rotatable casing forming a chamber for centrifugally separating the oil, water and contaminant matter in an oil well production fluid. The clean oil is collected by a stationary pitot tube in the chamber, the clean water is drawn off at an outlet port near the outer periphery of the chamber, and the dirty water and contaminants are discharged through outlet orifices formed in the outer wall of the casing. The agitating means includes rotating jet ports for directing streams of pressurized fluid tangentially along the inner surface of the casing to agitate accumulations of separated solid contaminant matter thereby preventing the clogging of the outlet orifices.

1 Claim, 2 Drawing Figures

PUMP AND CENTRIFUGAL SEPARATOR APPARATUS

BACKGROUND OF THE INVENTION

1. Field of the Invention

The present invention relates in general to centrifugal separators and in particular to a method and apparatus for preventing the accumulation of centrifugally separated solid contaminant matter at the outlet passages in such separators.

2. Description of the Prior Art

Pitot pumps are a form of centrifugal pump and typically include a hollow rotatable casing disposed within a surrounding housing, means for delivering a fluid to be pumped to the casing, and a pitot tube fixed with respect to the casing for collecting fluid at a desired point in the casing spaced from its rotational axis. Such pumps also include a discharge sytem for receiving fluids from the pitot tube and for discharging the same at a desired pressure coaxially of the casing. Such pitot pumps are illustrated in U.S. Pat. Nos. 3,795,459; 3,817,659; and 3,838,939, all of which are owned by the assignee of the present invention.

One use of pitot pumps is to supply pressurized fluid to a hydraulic pump located in the bore of an oil well for pumping oil out of the well into a suitable collection facility. In such an application, the fluid may be a portion of the oil produced from the well itself. Very often, however, the oil taken from the well contains contaminants which tend to wear and damage the pump. It has, therefore, been proposed to construct a pitot pump to function as both a pump and as a centrifugal separator, in which contaminants are removed from the oil as the oil is pumped. Such a pump is illustrated in U.S. Pat. No. 3,817,446.

Experience with pitot pumps-separators of this type has shown that sand and other solid or heavy viscous contaminants in the fluid tend to accumulate on the inner surface of the rotatable casing. Ducts or orifices are provided around the periphery of the casing to discharge the contaminants from the casing separately from the discharge of the fluid. However, the accumulation of contaminants on the inner surface of the casing often causes the ducts or orifices to become clogged or plugged. Such clogging of the contaminant discharge orifices is a major problem in centrifugal separators.

U.S. Pat. No. 4,036,427 discloses a combination pitot pump and centrifugal separator wherein a stationary stirrer vane assembly is utilized to prevent the build-up of contaminant matter on the inner surface of the rotatable casing. The vane assembly extends into close proximity to the casing inner surface, generating turbulence in the outermost extent of the casing to dislodge accumulated contaminant matter. The outer end portion of the vane assembly can be constructed to direct a jet of relatively clean fluid toward the inner surface of the rotatable casing. However,the relatively high speed of the contaminant containing fluid moving past the vane causes a high rate of wear at the end of the vane in these prior art devices.

SUMMARY OF THE INVENTION

The present invention concerns a centrifugal separator including a rotatable casing mounted for rotation about an axis, means for delivering a contaminated fluid to the interior of the casing, a pitot tube fixed with respect to the casing for drawing off clean oil to a first clean fluid outlet, a radial passage opening into the casing at the outer periphery thereof for drawing off clean water to a second clean fluid outlet, orifice means formed in the outer periphery of the casing for discharging contaminant matter, and means for agitating the accumulations of centrifugally separated contaminant matter to prevent clogging of the orifice means.

In accordance with the present invention, rotating jet means are positioned adjacent the inner surface of the rotatable casing along the outer periphery thereof for directing a stream of relatively clean fluid tangentially along the inner surface of the casing. The stream of fluid agitates the accumulations of centrifugally separated contaminant matter collected on the inner surface, thereby preventing the contaminant matter from clogging the orifice means. The jet means are connected to an oil outlet to divert clean oil to function as the stream of clean fluid.

DESCRIPTION OF PREFERRED EMBODIMENTS

Figure 1:
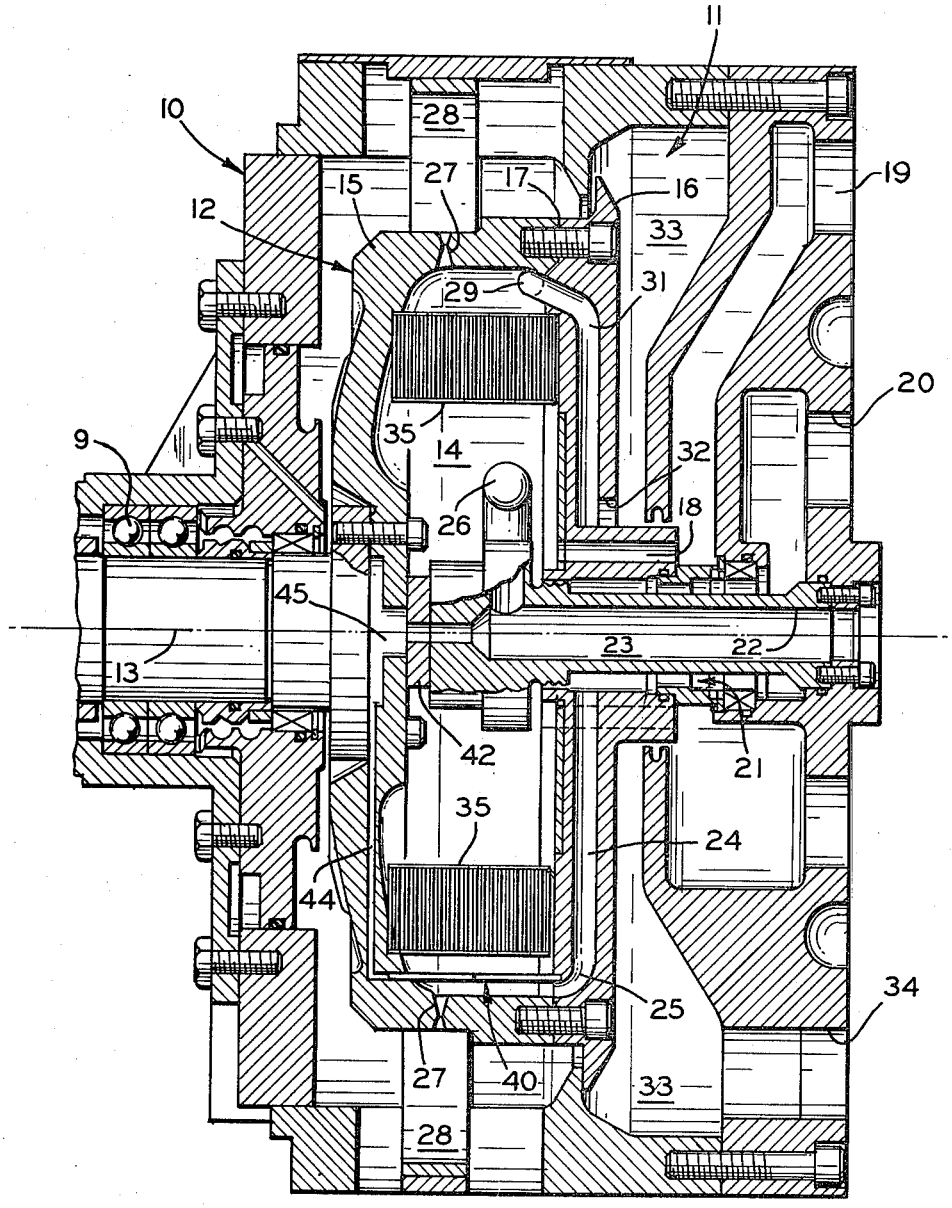
FIG. 1 is an elevational cross sectional view of a combination pitot pump-centrifugal separator apparatus embodying the present invention.

Referring to the drawings, there is illustrated in FIG. 1 a combination pitot pump and centrifugal separator apparatus having an outer housing 10 which defines an inner space 11 for enclosing a rotatable casing 12. The casing 12 is driven by a prime mover (not shown) about a horizontal axis 13. A chamber 14 formed within the rotatable casing 12 provides a volume for centrifugal separation of the phases of an oil well production fluid and a place for the fluid to receive the energy necessary to effect the centrifugal action on it.

The rotatable casing 12 is formed from a cup-shaped element 15 closed by a lid 16 which is attached to the element 15 by a plurality of suitable fasteners 17. The casing 12 is supported in the housing 10 by bearings 9 for rotation about the axis 13.

A production fluid intake 20 is formed in the wall of the housing 10 and communicates with the chamber 14 through an annular inlet passage 21 formed coaxially through an axial inlet hub of the rotatable casing 12. The passage 21 is connected to a plurality of radial passages 24 formed within the lid 16 and open to the chamber 14 adjacent the outer periphery of the casing 12, as at the port 25. Thus, the production fluid is drawn from the intake 20, through the annular passage 21, the radial passages 24, and the ports 25, into the chamber 14.

As the casing 12 is rotated, the lightest or gas phase of the production fluid is separated in the zone closest to the axis of rotation 13. A plurality of passages 18 are formed in the hub of the casing parallel to the axis 13 to connect the chamber 14 with a gas outlet 19. Thus, the gas is separated from the other constituents of the production fluid and is discharged from the pump-separator apparatus at the outlet 19.

A pitot tube 26 is positioned within the chamber 14 and is fixed relative to the rotatable casing 12. The tube 26 has an inlet facing in a direction opposite to the direction of rotation of the casing and an outlet connected to an axial discharge tube 22 defining a clean oil outlet 23. The tube extends through the center of the inlet passage 21 and the end wall of the outer housing 10. The inlet end of the pitot tube 26 is positioned intermediate the axis 13 and the outer periphery of the casing 12 in a zone of separated clean oil. Thus, the clean oil is collected by the pitot tube 26 and discharged from the pump-separator through the outlet 23.

Solid contaminant matter which is separated from the production fluid tends to settle at the outer periphery of the casing 12. A plurality of orifices 27 are formed in the outer wall of the casing 12 to discharge the contaminant matter from the casing 12. The contaminant matter falls to the bottom of a cavity 28 in the housing 10 and exits the cavity 28 with dirty water which has also passed through the orifices 27. Within the chamber 14, a circumferentially opening inlet port 29 supplies a radial passage 31 from the outer periphery of the casing 12 to an annular exit port 32. The inlet port 29 is positioned such that it receives clean water as the phases of the production fluid are centrifugally separated. The exit port 32 discharges the clean water into an annulus 33, which carries the water out of the pump at a discharge port 34. A stack of straighteners 35 having radial interstices between them is positioned within the rotatable casing 12 to flow fluids and solids radially of axis 13. The stack 35 reduces fluid motion to purely radial and circular action and promotes the separation of constituent phases of the production fluid.

Figure 2:
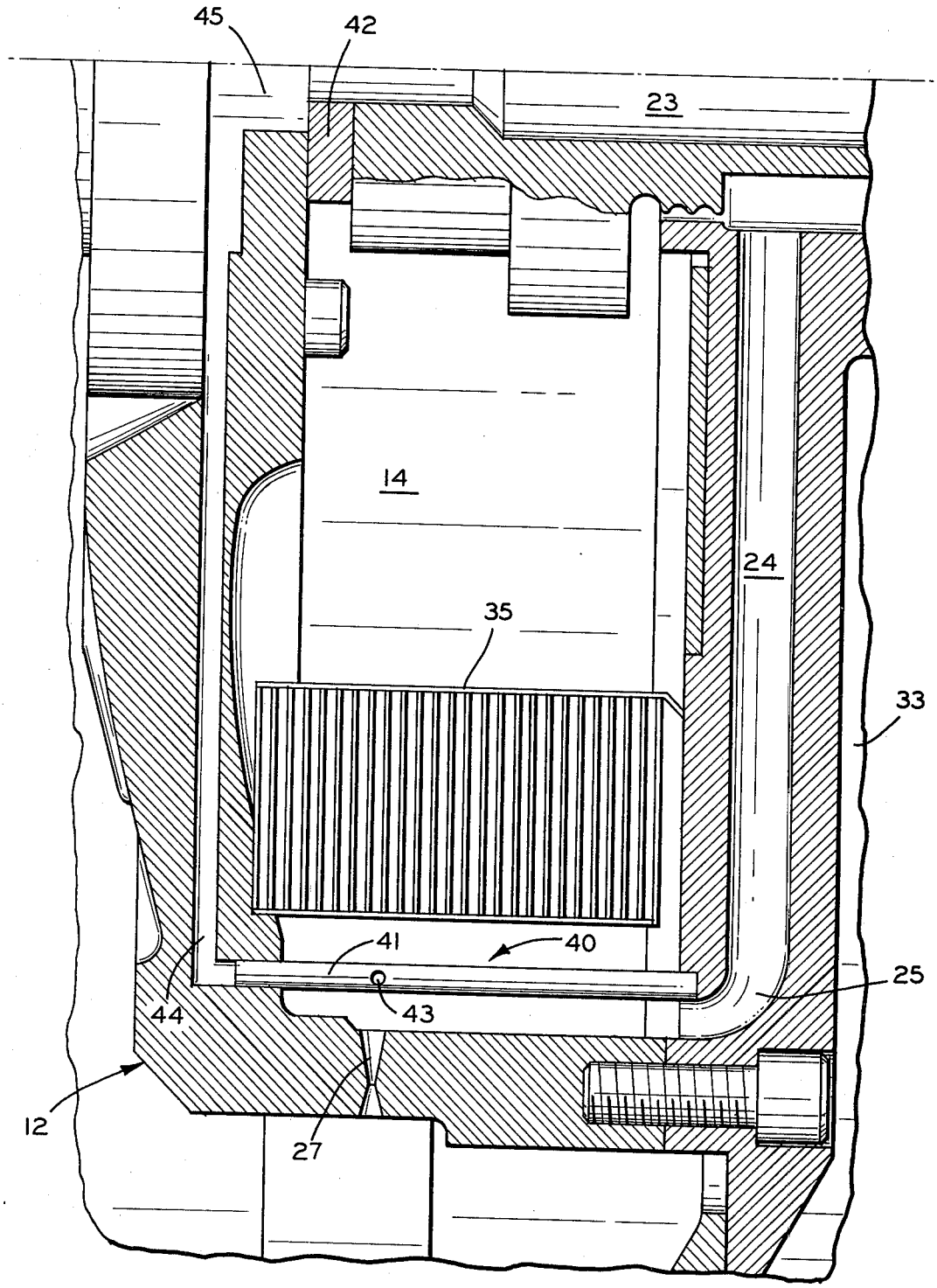
FIG. 2 is an enlarged fragmentary view of a portion of the apparatus illustrated in FIG. 1.

Near the outer periphery of the rotary casing 12 is located a means, generally indicated at 40, for agitating the accumulations of centrifugally separated contaminant matter. As shown particularly in FIG. 2, the peferred embodiment of the agitating means 40 includes jet means positioned adjacent the inner surface of the rotary casing 12 along the outer periphery thereof for directing a stream of fluid tangentially along the inner surface of the casing 12. The stream of fluid agitates the contaminant matter in the area of the orifices 27 and prevents the blockage of the orifices 27 by the contaminant matter. Thus, the orifices 27 do not become clogged and continue to discharge contaminant matter from the casing 12.

The jet means 40 can include a tube 41 having a coaxial feed passage formed therein for delivering pressurized fluid to a port 43 directed tangentially along the inner surface of the casing 12. The source of the pressurized fluid can be the clean oil outlet 23. Oil leaves the stationary outlet 23 through a seal 42 and enters a chamber 45 in the center of rotating casing 12. A feed channel 44 connects the chamber 45 to the tube 41 and supplies pressurized oil to the port 43.

In practice, the fluid which is injected tangentially along the inner surface of the rotatable casing through the port 43 agitates the separated contaminant matter and prevents the blockage of the orifices 27. This cleaning action prolongs the life of the pump by quickly removing the contaminants which wear out the moving parts of the pump. The present invention eliminates the use of a stirrer vane assembly which caused undesirable turbulence in regions other than near the inner surface of the casing 12. The use of the jet means 40 also permits a larger stack of straighteners 35 to be utilized, thus promoting more efficient separation of the constituent phases of the contamination fluid.

Although only one jet means 40 is illustrated, it should be appreciated that several jet means 40 can be spaced about the outer periphery of the casing 12 to uniformly agitate the separated contaminant matter. Similarly, a plurality of ports 43 can be formed in the jet means 40 without departing from the scope of the invention.

It should also be appreciated that the direction of the jet means 40 can be either with, against or transverse to the direction of rotation of the casing 12, depending on the type of solids being separated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a centrifugal separator apparatus for separating oil well production fluid into its constituents including a rotatable casing defining a pumping and separating chamber, means for delivering the production fluid to the chamber, means for collecting and discharging a pressurized clean fluid constituent of the production fluid from the casing, and a plurality of radially disposed orifices in the outer periphery of the chamber for discharging solid contaminant matter constituent from the casing, the improvement comprising: means in said casing defining a plurality of generally radially disposed fluid conduits connected at their inner end to the clean fluid collecting and discharging means for diverting a portion of the clean fluid into said radially disposed fluid conduits, a plurality of small diameter pipes mounted in and rotatable with said chamber and disposed in parallel relationship to the axis of rotation of said chamber, said pipes being respectively disposed adjacent to the radially disposed contaminant discharge orifices, each said pipe having at least one orifice in its side wall tangentially directed relative to the chamber periphery, and means in said casing respectively connecting the bores of said pipes to the outer ends of said radially disposed fluid conduits for discharging clean fluid tangentially past the entrance of said radially disposed solid contaminant discharge orifice, thereby preventing accumulations of solid contaminants in the vicinity of said orifice.

* * * * *